US010532858B2

(12) United States Patent
Druitt

(10) Patent No.: US 10,532,858 B2
(45) Date of Patent: Jan. 14, 2020

(54) CLOSURE FOR CONTAINER NECK FINISHES

(71) Applicant: CREANOVA UNIVERSAL CLOSURES LTD., Tewkesbury (GB)

(72) Inventor: Rodney Druitt, Bath (GB)

(73) Assignee: CREANOVA UNIVERSAL CLOSURES LTD., Tewkesbury (GB)

( * ) Notice: Subject to any disclaimer, the term of this patent is extended or adjusted under 35 U.S.C. 154(b) by 143 days.

(21) Appl. No.: 15/697,091

(22) Filed: Sep. 6, 2017

(65) Prior Publication Data

US 2019/0071222 A1 Mar. 7, 2019

(51) Int. Cl.

| | |
|---|---|
| ***B65D 41/04*** | (2006.01) |
| ***B65D 41/26*** | (2006.01) |
| ***B65D 41/34*** | (2006.01) |
| ***B65D 41/32*** | (2006.01) |

(52) U.S. Cl.

CPC ..... *B65D 41/0421* (2013.01); *B65D 41/26* (2013.01); *B65D 41/325* (2013.01); *B65D 41/34* (2013.01); *B65D 41/3423* (2013.01)

(58) Field of Classification Search

CPC ..... B65D 41/0421; B65D 41/325; B65D 41/3423; B65D 41/34; B65D 41/26

USPC ..... 215/252, 344

See application file for complete search history.

(56) References Cited

U.S. PATENT DOCUMENTS 4,489,845 A 12/1984 Aichinger et al.
4,807,771 A * 2/1989 Roy ..... B65D 41/3433 215/252
6,021,912 A 2/2000 Hertrampf
6,152,316 A * 11/2000 Niese ..... B65D 41/3428 215/252
6,695,161 B2 2/2004 Kano et al.
6,874,648 B2 4/2005 Willingham et al.
7,014,055 B2 3/2006 Kano et al.
7,575,121 B2 8/2009 Ooka et al.

(Continued)

FOREIGN PATENT DOCUMENTS

EP 0 076 778 A1 4/1983
EP 1 666 370 A1 6/2006

(Continued)

OTHER PUBLICATIONS

Co-pending U.S. Appl. No. 15/906,848, M. Smith et al., "CLOSURE," filed Feb. 27, 2018.

*Primary Examiner* — James N Smalley

(74) *Attorney, Agent, or Firm* — Pauley Erickson & Kottis

(57) ABSTRACT

The invention is directed to a closure (1) having a base (3) with a top deck (4) and a therewith adjacent skirt (5) extending in an axial direction (z) comprising an internal thread (6). The closure (1) is comprising a sealing arrangement (16) with an inner seal (18) extending in the axial direction (z) from the top deck (4). The inner seal (18) is having an inner annular sealing surface (29) arranged radially inward with respect to an outer seal (17) and pointing in an outward direction. The sealing arrangement further comprises an outer seal (17), which in its cross-section comprises a base section (20) extending in the axial direction (z) from the top deck (4) and an end section (21), which is bend inwardly with respect to the course of the base section (20) in the direction of the inner seal (18) and which terminates in a sealing surface (22) pointing in an inward direction.

14 Claims, 2 Drawing Sheets

(56) References Cited

U.S. PATENT DOCUMENTS

| | | | | |
|---|---|---|---|---|
| 7,607,547 | B2 | 10/2009 | Kumata et al. | |
| D613,162 | S | 4/2010 | Druitt | |
| 8,066,433 | B2 | 11/2011 | Sabounjian | |
| 8,794,460 | B2 | 8/2014 | Druitt et al. | |
| 9,415,909 | B2 | 8/2016 | Druitt et al. | |
| 9,902,530 | B2 | 2/2018 | Smith et al. | |
| 2006/0255002 | A1* | 11/2006 | Takamatsu | B65D 41/0421 215/252 |
| 2013/0270272 | A1* | 10/2013 | Smith | B65D 41/0414 220/288 |

FOREIGN PATENT DOCUMENTS

| | | | |
|---|---|---|---|
| JP | 57-133851 | A | 8/1982 |
| JP | 58-73551 | A | 5/1983 |
| JP | 9-150846 | A | 6/1997 |
| JP | 2000-109105 | A | 4/2000 |
| JP | 3872546 | B2 | 1/2007 |
| JP | 2007-145341 | A | 6/2007 |
| JP | 4392873 | B2 | 1/2010 |
| JP | 4413071 | B2 | 2/2010 |
| JP | 4456681 | B2 | 4/2010 |
| JP | 4533597 | B2 | 9/2010 |
| WO | WO 89/12584 | A1 | 12/1989 |
| WO | WO 94/02371 | A1 | 2/1994 |
| WO | WO 99/03746 | | 1/1999 |
| WO | WO 00/56615 | A1 | 9/2000 |
| WO | WO 00/56616 | A1 | 9/2000 |
| WO | WO 01/87725 | A1 | 11/2001 |
| WO | WO 03/011699 | A1 | 2/2003 |
| WO | WO 03/022701 | A1 | 3/2003 |
| WO | WO 2005/039996 | A1 | 5/2005 |
| WO | WO 2006/024550 | A1 | 3/2006 |
| WO | WO 2006/024656 | A1 | 3/2006 |
| WO | WO 2006/097151 | A2 | 9/2006 |
| WO | WO 2006/117024 | A1 | 11/2006 |
| WO | WO 2012/095501 | A1 | 7/2012 |

* cited by examiner

CLOSURE FOR CONTAINER NECK FINISHES

BACKGROUND OF THE INVENTION

Field of the Invention

The invention relates to a closure, especially a closure for packages for liquids such as beverages. In particular the invention relates to a closure for neck finishes of containers for carbonated liquids such as soft drinks, but is well adapted to seal other containers such as glass or PET containers with contents at above or below atmospheric pressure or having gaseous components or requiring a hermetic seal.

Discussion of Related Art

Screw cap closures are well known from the prior art and are a subject of continuous optimization. One attempt is to reduce the weight of the closure because the major share of the price is caused by the material used to make the closure. Another attempt is to guarantee that during opening of the closure the seal breaks in the right sequence with respect to breaking of the bridges, which are arranged between the tamper band and the shell of the closure.

EP0076778 of Albert Obrist AG was filed in 1982 and is directed to a closure cap made of plastics material, which has a circular outer sealing lip having a thickness which continuously decreases versus its free end. The outer sealing lip is arranged in the region of the joint between an outer vertical skirt and a disc like top deck and points obliquely inwards. At its smallest diameter, the sealing lip has a rounded sealing portion. Below the sealing portion, the sealing lip is widened outwards in the manner of a funnel to receive a container opening. However, due to the obliged arrangement of the sealing lip, the sealing lip often tends to be distorted during application, especially crooked application onto a neck of a container. A further disadvantage consists in that, due to the inclined arrangement, this seal is relatively rigid and therefore not very good in adjusting in lateral direction.

U.S. Pat. No. 4,489,845 was filed in 1984 and assigned to Albert Obrist AG. U.S. Pat. No. 4,489,845 is directed to a screw-cap for closing a container opening. The cap has a sealing lip which is affixed to the cap top. The inner side-wall of the outer sealing lip has a diameter which is greater than the outer diameter of the container outer wall. A clamping device, which can be designed as an inner seal, creates a contraction of the cap top when the screw cap is screwed onto the container due to deformation of the outer shell of the closure, by which means the sealing lip shall be pressed against the container mouth. In this manner the sealing lip is only pressed radially against the container mouth during the course of the screwing-on process. Thereby, overstretching and damage to the material of the sealing lip shall be prevented. In an engaged position the sealing lip engages around the upper outer rim of the neck of a container opening. One disadvantage is that the described deformation of the closure is related to extensive operating forces. A further disadvantage consists in that the outer shell tends to break due to extensive stress and deformation (stress cracking), which results in complete failure of the closure and loss of the product.

WO03011699 filed in 2002 by Bericap is directed to a closure cap comprising an internal sealing skirt, which is substantially truncated and converges from the sealing skirt base towards the free end of the sealing skirt. The inside of the sealing skirt is designed to cooperate with the outside of the neck. The internal diameter of the sealing skirt towards its free end portion is designed smaller than the external diameter of the neck. As described, the closure can comprise an annular v-notch designed to improve attachment of a liner to the rim of the neck or contact between the liner and the rim.

From the same inventor several patent applications are known in the field of the invention, which are primarily directed to sealing technology and/or closures. Examples are WO2012095501, WO2006117024, WO06024550, WO06024656, WO06097151, WO03022701, WO0056615, WO0056616, WO9903746, WO9402371 WO8912584, U.S. Pat. No. 6,874,648 and U.S. D 613,162.

Further patent publications showing several sealing technologies and/or closures are e.g. JP57133851, JP58073551, U.S. Pat. Nos. 4,489,845, 6,874,648, JP9150846, JP3872546, JP4392873, JP2000109105, JP4456681, U.S. Pat. No. 7,014,055, WO0187725, U.S. Pat. No. 6,695,161, JP4533597, WO05039996, JP4413071, U.S. Pat. No. 7,575,121, JP2007145341 or U.S. Pat. No. 7,607,547.

BRIEF SUMMARY OF THE INVENTION

It is an object of the invention to provide a closure having an improved functionality during opening. It is a further aspect of the invention to provide a closure which allows to adjust the sequence of breaking of the seal and breaking of the tamper evidence of the closure.

The closure is foreseen to be used with standardized neck finishes of containers and the like as known from prior art. The standardized neck finishes comprise an outer peripheral surface with an external thread. The outer peripheral surface blends by an edge surface into an annular top surface, which forms the upper end of the container when it is standing upright. Between the annular top surface and the external thread an outer free surface extends over a length of approximately 1 mm to 3 mm of the neck, which is not covered by the thread and suitable for sealing purposes. The neck of the container comprises an in general cylindrical, inner peripheral surface adjacent to the annular top surface. Furthermore the neck finish comprises a circumferential bead protruding outwardly in a radial direction. The circumferential bead is arranged at a certain distance from the annular top surface below the external thread. It is foreseen to interact with and provide hold for a tamper band of a closure applied thereon.

A closure according to the invention comprises a base with a top deck and a therewith adjacent skirt with an internal thread or similar retaining means suitable to be engaged with the external thread of a neck finish as described above. The closure further comprises a tamper band attached to a lower free end of the outer skirt and integrally attached thereto by frangible bridges or similar means such as at least one thin web of material.

In a preferred variation the closure is having a base with a top deck and a therewith adjacent skirt extending in an axial direction. The skirt is comprising an internal thread and/or other means to attach the closure to a neck finish, e.g. of a container or a bottle. The closure comprises on the inside a sealing arrangement with an inner seal extending in the axial direction from the top deck. The inner seal is comprising an inner sealing surface arranged radially inward with respect to an outer seal. The inner sealing surface is arranged in a (radially) outward direction and foreseen to interact with the neck finish when in a mounted position on the neck finish from the inside. The inner seal is therefore foreseen to reach into the opening of the neck finish. The outer seal is arranged concentric and radially outward to and spaced apart from the inner seal. In its cross-section it comprises a base section extending in the axial direction from the top deck and merges into an end section, which is bend inwardly with respect to the course of the base section in the direction of the inner seal. The end section terminates in a sealing surface pointing in an inward direction. Good results can be achieved when the cross-section of the outer seal is defined by an inner concave side wall which merges into the sealing surface. Preferably the thickness of the outer seal basically remains constant and/or constantly decreases in the direction of the outer sealing surface. To obtain a smooth transition, the base section of the outer seal can blend by an inner transition region into the top deck and by an outer transition region into the top deck and/or the skirt. Good results can be achieved when the average radius of the inner transition region is larger than the average radius of the outer transition region. The sealing arrangement comprises a location surface arranged between the outer seal and the inner seal acting as a stop between the neck finish and the closure when applied to the neck finish. In a preferred variation, the outer sealing surface of the outer seal is in the axial direction spaced a first distance apart from the location surface and the inner sealing surface of the inner seal in the axial direction is spaced a second distance part from the location surface, wherein the second distance is normally larger than the first distance. In that it is possible to determine which seal breaks first when unscrewing the closure from the neck finish. Furthermore by proper adjustment of the first and the second distance with respect to the location surface in combination with the distance between the location surface and the tamper band which interacts with the thereto related circumferential of the neck finish as mentioned above, it becomes possible to meet the technical requirements demanded by the industry. In a preferred variation the annular base of the inner seal is supported by ribs from the inside. Good results can be achieved when the extension of the ribs in the axial direction with respect to the location surface (hereinafter referred to as third distance) is chosen such that the third distance is larger than the first distance but smaller than the second distance. The ribs on the inside face of the plug seal help to prevent the plug seal from relaxing which would result in product leak. The closure offers the possibility to be adjusted, such that the bridges between the tamper band and the skirt break before the seal releases. Due to the bridges, the inner seal can be made longer compared to the outside seal. In a preferred variation which offers superior venting capabilities the internal thread arranged in the skirt of the closure comprises several rows of thread segments spaced apart in circumferential direction by channels extending in the axial direction along an inner side wall of the skirt. In combination with the above the described sealing arrangement, the channels in the axial direction preferably end at a fourth distance apart from the location surface, wherein the fourth distance is less than the second distance.

Superior performance can be achieved when the above mentioned sealing arrangement is combined with a tamper band which is interconnected to the skirt by at least one frangible element such as a bridge or a thin web of material wherein the tamper band comprises a base section and a foldable section interconnected to the base section by a hinge and foldable between an unfolded and a folded position. The foldable section may comprise retainer beads arranged distributed along the foldable section and extending from a free end of the foldable section. In the mounted position the retainer beads are foreseen to interact with an undercut of the neck finish, e.g. a circumferential bead protruding outwardly from the neck finish. Tamper band may comprise at least one drainage hole arranged adjacent to the hinge. In the folded position extensions may be are arranged between the foldable section and the base section of the tamper band supporting the foldable section from the inside. If appropriate the hinge interconnecting the base section and the foldable section of the tamper band may be arranged inside of the base section separated by a circumferential groove from a lower end of the base section.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
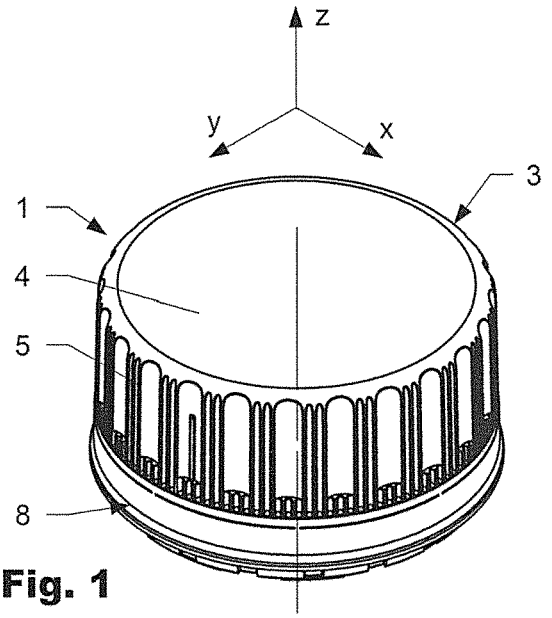
FIG. 1 is a closure according to the invention in perspective view from above.
Figure 2:
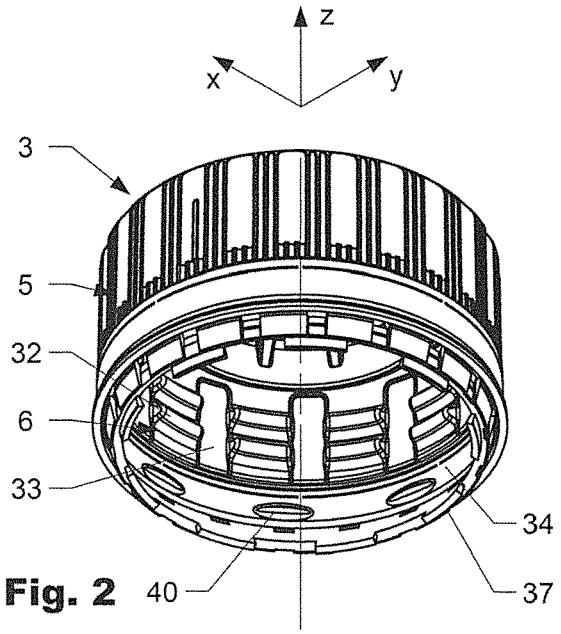
FIG. 2 is the closure according to FIG. 1 in a perspective view from below.
Figure 3:
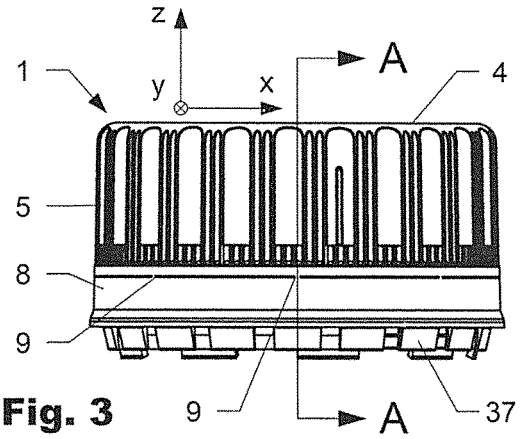
FIG. 3 is the closure according to FIG. 1 in a side view.
Figure 4:
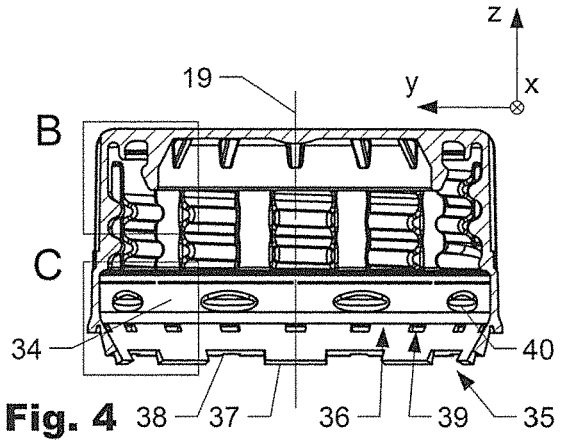
FIG. 4 is a section view along section line AA.
Figure 5:
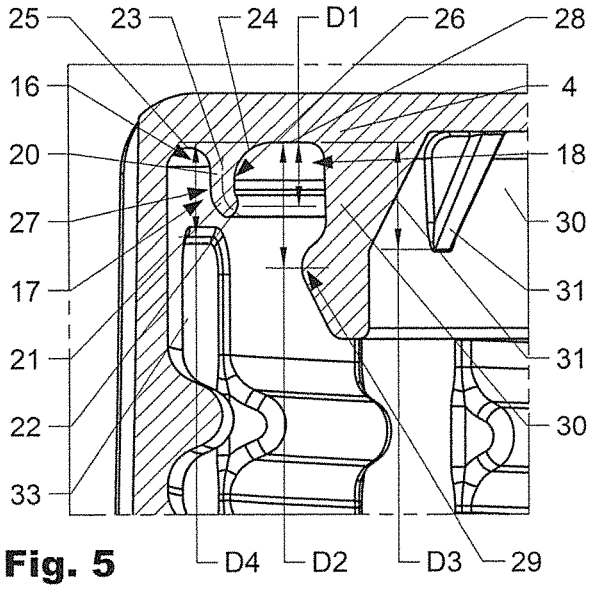
FIG. 5 is detail B according to FIG. 4.
Figure 6:
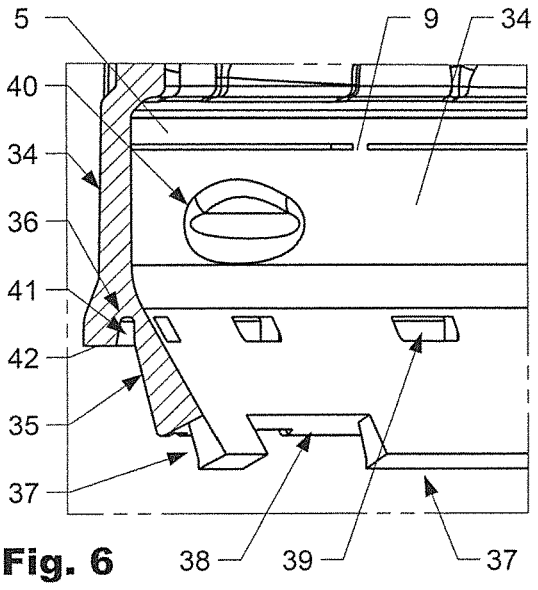
FIG. 6 is detail C according to FIG. 4.
Figure 7:
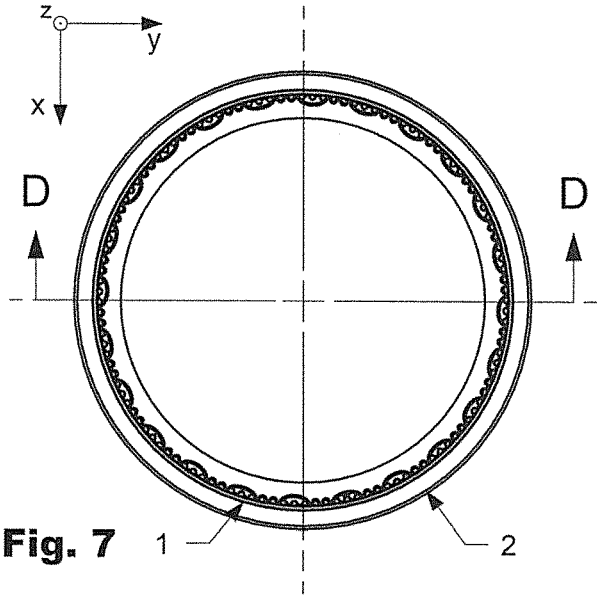
FIG. 7 is a top view of the closure according to FIG. 1.
Figure 8:
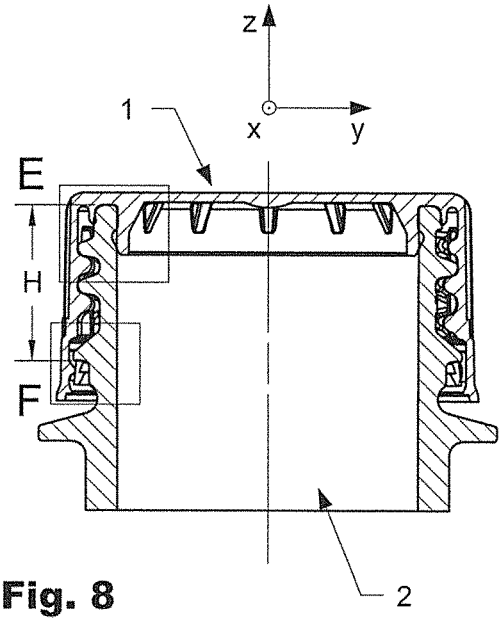
FIG. 8 is a section view according to section line DD according to FIG. 7.
Figure 9:
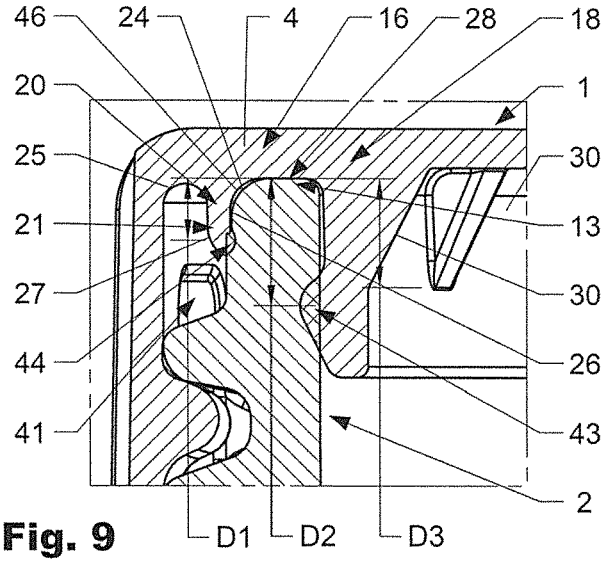
FIG. 9 is detail E according to FIG. 8.
Figure 10:
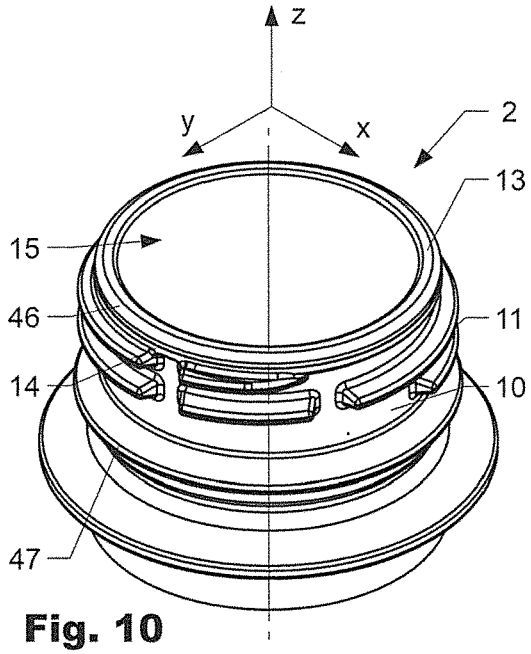
FIG. 10 is a perspective view of a neck finish for a closure according to FIG. 1

FIG. 1 shows an embodiment of a closure 1 according to the invention in a perspective view from above. FIG. 2 is showing the closure 1 in a perspective view from below. FIG. 3 is showing the closure 1 in a side view, and FIG. 4 in a section view along section line AA of FIG. 1. FIG. 5 is showing detail B according and FIG. 6 detail C according to FIG. 4. FIG. 7 is showing the closure 1 in a top view and FIG. 8 in a section view along section line DD according to FIG. 7. FIG. 9 is showing detail E according to FIG. 8. FIG. 10 is showing a neck finish 2 suitable to receive a closure 1.

The closure 1 comprises a base 3 with a top deck 4 and a therewith adjacent skirt 5 with an internal thread 6 or similar retaining means suitable to be engaged with an external thread 7 of a neck finish 2 as shown in FIG. 10. In the shown variation the top deck 4 is disc like. Depending the field of application, the top deck 4 can have a different design, e.g. a spout, etc. (not shown in detail).

The closure 1 further comprises a tamper band 8 attached to a lower free end of the outer skirt 5. In the shown variation it is integrally attached thereto by frangible bridges 9 or similar means such as a thin web of material (not shown in detail).

The closure 1 is foreseen to be used with standardized neck finishes 2 as known from prior art. An example of a standardized neck finish is shown in FIG. 10. The standardized neck finish 1 comprises an outer peripheral surface 10 with an external thread 11. The outer peripheral surface 10 blends by an edge surface 12 into an annular top surface 13. Between the annular top surface 13 and the external thread 11 an outer free surface 14 extends over a length of approximately 1 mm to 3 mm of the neck, which is not covered by the thread and suitable for sealing purposes. The neck 2 comprises an in general cylindrical, inner peripheral surface 15 adjacent to the annular top surface 13. Furthermore the neck finish 2 comprises a circumferential bead 47 protruding outwardly in a radial direction. The circumferential bead 47 is arranged parallel at a certain distance H (see FIG. 8) from the annular top surface 13 below the external thread 7. It is foreseen to provide hold for the tamper band 7 of a closure applied thereon.

As visible in the sectional view according to FIG. 5 the closure 1 comprises on the inside a sealing arrangement 16 comprising an outer seal 17 and a bore seal 18 which are arranged concentric with respect to an axial direction of a closure axis 19. In its cross-section the outer seal 17 extends from the top deck 4 into the outer skirt 5. Wherein a base section 20 extends approximately perpendicular from the top deck and merges into an end section 21 which is bend inwardly against the bore seal 18 as will be described hereinafter in more detail. The end section 21 terminates in an outer annular sealing surface 22 protruding radially inwardly. The principle course of the outer seal 17 is in the cross-section according to FIG. 5 schematically indicated by dotted line 23. In the shown variation the outer seal 17 is interconnected to the top deck 4 by an inner and an outer transition region 23, 24. The cross-section of the outer seal 17 is defined by an inner and an outer sidewall 26, 27, which blend at the free end of the outer seal 17 into the annular sealing surface 22. In the sectional view the inner sidewall 26 is having a concave design bent in an inward direction against the bore seal 18. The outer side wall 27 has basically a convex design following the inner side wall 26.

When in a mounted position as schematically shown in FIG. 9 the outer annular sealing surface 22 interacts with the outer free surface of the neck finish 2. The with respect to the radial direction most inner point of the outer annular sealing surface 22 is arranged at a distance D1 from a locating surface 28 arranged between the outer and the inner seal 17, 18. The locating surface 28 acts as a stop for the annular top surface of the neck finish 13. If appropriate it can contribute to the sealing performance of the sealing arrangement 16.

As visible, the wall thickness of the area of the top deck 4 arranged radially inside the inner seal 18 is in the shown embodiment at least partially thinner than the wall thickness of the top deck 4 in the area of the locating surface 28. This offers the opportunity to reduce the overall weight of the closure without negative influence on the sealing performance.

As visible in the section view according to FIG. 5, the inner seal (bore seal) 18 is extending from the top deck of the closure 1 inside the outer skirt 5. It comprises an inner annular sealing surface 29 protruding in an outward direction above an annular base 30. The with respect to the radial direction most outer point of the inner annular sealing surface 29 is arranged at a distance D2 from a locating surface 28 arranged between the outer and the inner seal 17, 18. The bore seal 18 is supported by ribs 31 which extend from the top deck 4 into the bore seal 18. Depending on the field of application, the design of the ribs 31 can have a relevant influence on the functionality of the closure 1 when breaking the seal in combination with the behavior of the tamper evidence, i.e. breaking of the bridges between the tamper band 8 and the outer skirt 5. In the shown variation the axial length of the ribs 31 is indicated by distance D3.

In a variation the closure 1 is having a base 3 with a top deck 4 and a therewith adjacent skirt 5 extending in an axial direction z. The skirt comprises an internal thread 6 foreseen to be interconnected to the external thread 7 of the neck finish 2 as schematically shown in FIG. 8. The closure 1 is shown in an undeformed manner sitting on the neck finish 2. This behavior does not correspond to the behavior of the real closure when applied on a neck finish, as the geometry of the closure 1 is foreseen to deform in a controlled manner to achieve the specifications needed. The interaction of the several elements and dimensions is preferably as described hereinafter. Thereby it is possible to achieve a lightweight closure which provides a superior performance compared to other closures known from the prior art. The closure 1 is having a sealing arrangement 16 with an inner seal 18 extending in the axial direction z from the top deck 4 comprising an inner sealing surface 29 arranged radially inward with respect to an outer seal 17 and pointing in an outward direction. In the applied position the inner sealing surface 29 interacts with the inner peripheral surface 15 of the neck finish forming a first sealing area 43. The sealing arrangement 16 comprises an outer seal 17, which in its cross-section comprises a base section 20 extending in the axial direction z from the top deck 4 inside the skirt 5. The base section 20 merges into an end section 21, which is bend inwardly with respect to the course of the base section 20, in the direction of the inner seal 18 and which terminates in a sealing surface 22 pointing in an inward direction. In the applied position as visible in FIG. 8, the sealing surface 22 forms a second sealing area 44 with the outer free surface 14 of the neck finish 2. The cross-section of the outer seal 17 is preferably defined by an inner and an outer concave side wall 26, 27 which merge into the sealing surface 22. If appropriate a third sealing area 45 can be established between the inner transition region 24 and an edge surface 46 arranged between the outer free surface 14 and the annular top surface 13 of the neck finish 2. In the preferred variation as shown the thickness of the outer seal 17 constantly decreases in the direction of the outer sealing surface 22. The average radius of the inner transition region 24 is preferably larger than the average radius of the outer transition 25 region. The sealing arrangement 16 comprises a location surface 28 arranged between the outer seal 17 and the inner seal 18 and wherein in the axial direction z the outer sealing surface 22 of the outer seal 17 is spaced a first distance D1 apart from the location surface 28 and the inner sealing surface 29 of the inner seal 18 is spaced a second distance D2 apart from the location surface 28. The annular base 30 of the inner seal 18 is supported by ribs 31 from the inside, wherein the extension of the ribs 31 in the axial direction z with respect to the location surface 28 is defined by a third distance D3. In the shown variation the second distance D2 is larger than the first distance D1 and the third distance D3 is between the first and the second distance DE D2. If appropriate the third distance can be chosen larger than the second distance D2.

As visible in FIG. 5, the thread 6 comprises several rows of thread segments 32 spaced apart by channels 33 extending in the axial direction along an inner side wall of the skirt 5. The channels 33 in the axial direction end a fourth distance D4 apart from the location surface 28, wherein the fourth distance D4 is less than the second distance D2. This helps to support venting of the closure 1 when unscrewing it from the neck finish.

Figure 11:
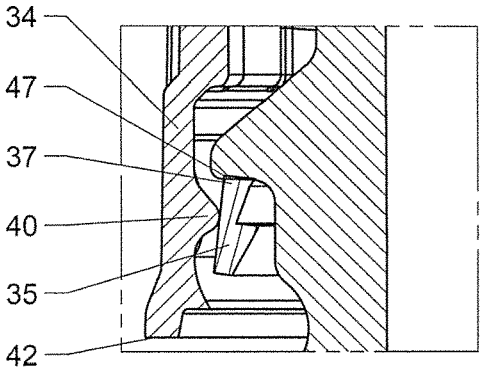
FIG. 11 is detail F according to FIG. 8.

In FIG. 11 the tamper band 8 is shown in a schematical manner on the neck finish 2. As visible in detail in FIG. 6, the tamper band 8 comprises a base section 34 and a foldable section 35 interconnected to the base section 34 by a hinge 36 (not shown in FIG. 11) and foldable between an unfolded (see FIG. 6) and a folded position (see FIG. 11). The foldable section 35 comprises retainer beads 37 arranged distributed along the foldable section 35 and extending from a free end 38 of the foldable section 35. The retainer beads 37 are foreseen to interact with an edge surface 47 of the neck finish 2. The tamper band 8 may comprise at least one drainage hole 39 which is preferably arranged adjacent to the hinge 36. If appropriate the at least one drainage hole 39 can interrupt the hinge. If appropriate extensions 40 can be arranged between the foldable section 35 and the base section 34 of the tamper band 6 to guarantee that the foldable section 35 is kept in the correct position, when applied to the neck finish 2. The tamper band 8 should thus be considered a separate inventive concept, which may be made subject of one or several divisional patent applications.

When disengaging the closure from the neck finish by unscrewing, it comes to a point where the inner seal contact point begins to disengage with the finish. The thread rotates until the bridges break via rotation torsion. Then the closure shell separates with the tamper band. The closure will continue to disengage the inner seal contact point 43. Until product begins to leak from the neck finish 2. The ribs 31 supporting the inner seal 18 from the inside allow to hold the inner seal in place without unwanted deforming after the closure 1 has been applied to the neck finish 2.

I claim:

1. A closure (1) comprising:

a. a base (3) with a top deck (4) and an adjacent skirt (5) extending in an axial direction (z) comprising an internal thread (6);

b. a sealing arrangement (16) with an inner seal (18) extending in the axial direction (z) from the top deck (4) comprising an inner annular sealing surface (29) arranged radially inward with respect to an outer seal (17) and pointing in an outward direction; and c. the outer seal (17), which in its cross-section comprises i. a base section (20) extending in the axial direction (z) from the top deck (4) and ii. an end section (21), which is bent inwardly with respect to the course of the base section (20) in the direction of the inner seal (18) and which terminates in a sealing surface (22) pointing in an inward direction;

wherein the sealing arrangement (16) comprises a location surface (28) arranged between the outer seal (17) and the inner seal (18) and wherein in the axial direction (z):

iii. the outer sealing surface (22) of the outer seal (17) is spaced a first distance (D1) apart from the location surface (28); and iv. the inner sealing surface (29) of the inner seal (18) is spaced a second distance (D2) apart from the location surface (28);

wherein the annular base (30) of the inner seal (18) is supported by ribs (31) from inside, wherein extension of the ribs (31) in the axial direction (z) with respect to the location surface (28) is defined by a third distance (D3); and wherein the second distance (D2) is larger than the first distance (D1) and the third distance (D3) is between the first and the second distance (D1, D2).

2. The closure (1) according to claim 1, wherein the cross-section of the outer seal (17) is defined by an inner concave side wall (26) and an outer convex side wall (27) which merge into the sealing surface (22).

3. The closure (1) according to claim 1, wherein the outer seal (17) has a cross-section having a thickness that constantly decreases in the direction of the outer sealing surface (22).

4. The closure (1) according to claim 1, wherein the base section (20) of the outer seal (17) blends by an inner transition region (24) into the top deck (4) and by an outer transition region (25) into the skirt (5).

5. The closure (1) according to claim 4, wherein in a cross section an average radius of the inner transition region (24) is larger than an average radius of the outer transition (25) region.

6. The closure (1) according to claim 1, wherein a wall thickness of the area of the top deck (4) arranged radially inside the inner seal (18) is at least partially thinner than a wall thickness of the top deck (4) in the area of the locating surface (28).

7. The closure (1) according to claim 6, wherein the thread (6) comprises several rows of thread segments (32) spaced apart by channels (33) extending in the axial direction along an inner side wall of the skirt (5).

8. The closure (1) according to claim 7, wherein the channels (33) in the axial direction end a fourth distance (D4) apart from the location surface (28), wherein the fourth distance (D4) is less than the second distance (D2).

9. The closure (1) according to claim 1, wherein a tamper band (8) is interconnected to the skirt (5) by at least one frangible element (9).

10. The closure (1) according to claim 9, wherein the tamper band (8) comprises a base section (34) and a foldable section (35) interconnected to the base section (34) by a hinge (36) and foldable between an unfolded and a folded position.

11. The closure (1) according to claim 10, wherein the foldable section (35) comprises retainer beads (37) distributed along the foldable section (35) and extending from a free end (38) of the foldable section (35).

12. The closure (1) according to claim 9, wherein the tamper band (8) comprises at least one drainage hole (39) arranged adjacent to the hinge (36).

13. The closure (1) according to claim 10, wherein in the folded position, the closure includes extensions (40) arranged between the foldable section (35) and the base section (34) of the tamper band (6).

14. The closure (1) according to claim 9, wherein the hinge is arranged inside of the base section (34) separated by a circumferential groove (41) from a lower end (42) of the base section (34).

* * * * *